US011143464B2

(12) United States Patent
Dolderer et al.

(10) Patent No.: US 11,143,464 B2
(45) Date of Patent: Oct. 12, 2021

(54) COLLECTOR TUBE FOR A HEAT EXCHANGER

(71) Applicant: Mahle International GmbH, Stuttgart (DE)

(72) Inventors: Axel Dolderer, Grossbottwar (DE); Uwe Foerster, Erdmannhausen (DE); Martin Kaspar, Fellbach (DE)

(73) Assignee: Mahle International GmbH

( * ) Notice: Subject to any disclaimer, the term of this patent is extended or adjusted under 35 U.S.C. 154(b) by 42 days.

(21) Appl. No.: 16/691,572

(22) Filed: Nov. 21, 2019

(65) Prior Publication Data

US 2020/0200491 A1 Jun. 25, 2020

(30) Foreign Application Priority Data

Nov. 23, 2018 (DE) ..... 10 2018 220 142.0

(51) Int. Cl.
*F28F 9/02* (2006.01)
*F28F 9/04* (2006.01)

(52) U.S. Cl.
CPC ..... *F28F 9/0224* (2013.01); *F28F 9/0202* (2013.01); *F28F 9/04* (2013.01)

(58) Field of Classification Search
CPC ..... F28F 9/0224; F28F 9/0202; F28F 9/04
USPC ..... 165/173
See application file for complete search history.

(56) References Cited

U.S. PATENT DOCUMENTS 5,107,926 A 4/1992 Calleson
6,145,589 A 11/2000 Gowan
6,289,980 B1 9/2001 Insalaco et al.
6,397,627 B1 * 6/2002 Aki ..... F25B 39/04 62/509
9,097,469 B2 8/2015 Foerster et al.
9,523,540 B2 12/2016 Hirayama et al.
9,546,828 B2 1/2017 Moreau et al.
2007/0074860 A1 4/2007 Shinhama
2010/0038063 A1 * 2/2010 Saumweber ..... F28F 9/182 165/173
2012/0138282 A1 6/2012 Foerster et al.

(Continued)

FOREIGN PATENT DOCUMENTS

DE 41 30 517 A1 3/1993
DE 10 2007 016 050 A1 10/2007

(Continued)

OTHER PUBLICATIONS

English abstract for FR-2 952 711.

(Continued)

*Primary Examiner* — Davis D Hwu
(74) *Attorney, Agent, or Firm* — Fishman Stewart PLLC

(57) ABSTRACT

A collector tube for a heat exchanger, which may have at least one flat tube, may include a base and a cover arranged opposite one another and embodying a longitudinal duct. The base may have at least one passage having an opening for accommodating the at least one flat tube of the heat exchanger. The at least one passage may have a collar, which may extend away from the longitudinal duct. The cover may have at least one notch, which may be located opposite the at least one passage and which may be embodied for accommodating a subarea of the at least one flat tube.

19 Claims, 2 Drawing Sheets

(56) References Cited

U.S. PATENT DOCUMENTS

| | | | | |
|---|---|---|---|---|
| 2012/0285423 | A1* | 11/2012 | Nguyen | F28F 9/0214 123/542 |
| 2014/0298853 | A1* | 10/2014 | Diem | F28F 9/0251 62/467 |
| 2016/0054069 | A1* | 2/2016 | Armsden | B21D 53/085 165/173 |
| 2016/0356532 | A1 | 12/2016 | Wijaya et al. | |

FOREIGN PATENT DOCUMENTS

| | | | |
|---|---|---|---|
| DE | 10 2006 053 702 | A1 | 5/2008 |
| DE | 10 2009 023 954 | A1 | 12/2010 |
| DE | 10 2013 205 763 | A1 | 10/2013 |
| EP | 1 347 259 | A1 | 9/2003 |
| EP | 2 097 707 | A1 | 9/2009 |
| EP | 2 648 862 | B1 | 1/2017 |
| FR | 2 952 711 | A1 | 5/2011 |
| JP | H08-334 292 | A | 12/1996 |
| JP | 2004-211 925 | A | 7/2004 |
| WO | 2014/131 756 | A1 | 9/2014 |
| WO | 2015/079 653 | A1 | 6/2015 |
| WO | 2015/086 195 | A1 | 6/2015 |

OTHER PUBLICATIONS

English abstract for DE-10 2006 053 702.
English abstract for DE-10 2007 016 050.
English abstract for JP-H08-334 292.
English abstract for JP-2004-211 925.
English abstract for DE-41 30 517.

* cited by examiner

COLLECTOR TUBE FOR A HEAT EXCHANGER

CROSS-REFERENCE TO RELATED APPLICATIONS

This application claims priority to German Patent Application No. DE 10 2018 220 142.0, filed on Nov. 23, 2018, the contents of which are hereby incorporated by reference in their entirety.

TECHNICAL FIELD

The present invention relates to a heat exchanger for a vehicle as well as to a collector tube for such a heat exchanger.

In vehicles, heat exchangers and in particular condensers are used, for example, as part of an air conditioning circuit for regulating the room temperature in the vehicle interior. The heat exchanger or condenser, respectively, has a plurality of flat tubes, which are spaced apart from one another and which are fluidically connected to one another by means of at least one collector tube. A gaseous refrigerant, which was compressed by a compressor of the air conditioning circuit, initially flows into the collector tube through an inlet and subsequently through the flat tubes. While the refrigerant flows through the flat tubes, it dissipates its heat energy to the flat tubes or to the surrounding area of the flat tubes, respectively, so that it cools down and condenses. The condensed or liquid refrigerant, respectively, is supplied to the air conditioning circuit again via an outlet.

A collector tube for heat exchangers or condensers, respectively, is typically embodied as one-piece round tube, which has an essentially round cross section. The collector tube has openings, into which flat tubes comprising a specified width are inserted. The flat tubes thereby partially protrude into the longitudinal duct and thus reduce the usable diameter of the longitudinal duct. So that a fluid, such as a refrigerant, does not experience too large of a flow resistance due to the protruding flat tubes, the longitudinal duct of the round tube has a diameter, which is equal to or larger than the width of the flat tubes.

The openings can be punched or can also be embodied in combination with a passage. During the production of the heat exchanger or condenser, respectively, the flat tubes are soldered to the collector tube, in order to establish a fluid-tight and mechanically stable connection. Passages are advantageous thereby, because the surfaces, which are to be soldered, of the respective flat tube and of the collector tube are increased and a more stable solder connection can thus be established.

Passages, which protrude into the collector tube, belong to the known prior art. A collector tube is also known from EP 2 097 707 B1, in the case of which the passages extend away from the collector tube. The flat tubes, which are embodied as micro duct flat tubes, thereby protrude into the collector tube, in order to prevent clogging of the micro ducts of the flat tubes by the soldering material.

It is a disadvantage of these collector tubes that pocket areas form in the longitudinal duct between the protruding flat tubes and/or passages, which pocket areas are filled with refrigerant, but which do not contribute to the function of the heat exchanger or condenser, respectively, because the refrigerant accumulates in these pocket areas and cannot flow in the longitudinal direction of the longitudinal duct. This leads to an increased flow resistance along the longitudinal duct and to an increased dead weight of the heat exchanger or condenser, respectively, because unnecessary refrigerant has to be filled in.

To decrease these pocket areas, FR 2 952 711 A1 and EP 2 648 862 B1 proposes that the collector tube is made up of two components. The first component is a base, which has at least one opening for a flat tube, the second component is a cover. The base and the cover are joined together, wherein the two components are connect to one another in a fluid-tight manner during the production, so as to embody a longitudinal duct. This longitudinal duct does not have a round cross section, but a semi-circular cross section comprising an arch area and a base area, wherein the cross section of the base area has a larger curvature radius than the arch area.

The base area is embodied essentially by means of a subarea of the base, wherein this subarea is essentially flat. The arch area is embodied essentially by a subarea of the cover. The length of the base area and thus the diameter of the longitudinal duct essentially corresponds to the width of the flat tubes. Passages are proposed in FR 2 952 711 A1 and in EP 2 648 862 B1, which protrude into the longitudinal duct, so that even through pocket areas also form in the case of these solution, they have a smaller available space than the pocket areas, which are created in the case of one-piece round tubes, due to the base area, which is embodied to be flat. The required amount of refrigerant as well as the dead weight of the heat exchanger or condenser, respectively, is thus reduced.

SUMMARY

The present invention is based on the object of further developing the collector tubes of the latter type in such a way that the required amount of refrigerant can be reduced.

This problem is solved according to the invention by means of the subject matters of the independent claims. Advantageous embodiments are subject matter of the dependent claims.

The present invention is based on the general idea that the base of the collector tube has passages, which extend away from the longitudinal duct, wherein at least one notch, which is embodied to accommodate a subarea of a flat tube, can be located opposite at least one passage.

The collector tube according to the invention can be used in a heat exchanger or condenser, respectively, wherein the heat exchanger or condenser, respectively, has at least one flat tube. A heat exchanger or condenser, respectively, typically has a plurality of flat tubes, which are arranged spaced apart from one another. Fins can be provided between these flat tubes so as to improve the stability of the heat exchanger or condenser, respectively, and so as to improve enlarge the surface, over which a heat exchange with the external environment of the heat exchanger or condenser, respectively, can take place.

The flat tube limits at least one available space or a duct, respectively, from the external environment, through which the refrigerant can flow, in order to condense, for example. This flat tube has at least two front sides, the distance of which defines the length of the flat tube. The flat tube has an essentially rectangular cross section.

The collector tube is embodied at least in two parts, wherein the first component is a base and the second component is a cover. The base and the cover are arranged so as to be located opposite one another and embody a longitudinal duct.

The base can have an outer base surface and an inner base surface. The outer base surface is defined as the surface of the base, which is in contact with the external environment in the case of the assembled collector tube. The remaining surface of the base, which is not in contact with the external environment in the case of the assembled collector tube, is defined as inner base surface.

The cover can have an outer cover surface and an inner cover surface. The outer cover surface is defined as the surface of the cover, which is in contact with the external environment in the case of the assembled collector tube. The remaining surface of the cover, which is not in contact with the external environment in the case of the assembled collector tube, is defined as inner cover surface.

The base and the cover can be assembled in such a way that the longitudinal duct is fluid-tight with respect to the external environment. For this purpose, the base can have at least one base collar. It can be provided that subareas of the inner base surface are in contact with subareas of the inner cover surface. The subarea of the inner base surface, which is not in direct contact with the inner cover surface, is defined as base area. The subarea of the inner cover surface, which is not in contact with the inner base surface, is defined as arch area. The arch area can have a diameter or a width in the cross section, respectively, which is larger than the width of the openings.

The base area and the arch area can limit the longitudinal duct. The longitudinal duct can have an essentially semi-circular cross section, wherein the semi-circular contour can be formed by the arch area. The base area can be located opposite the semi-circular contour.

It can be provided that the base is embodied to be essentially flat. In this context, flat can be understood such that in the cross section of the longitudinal duct, the base area has at least one curvature radius, which is larger than the smallest curvature radius of the arch area. The arch area can thereby curve away from the base. The base area can curve away from the cover and/or towards the cover. A curvature of the cover can lead to an improved pressure stability.

The base has at least one passage comprising an opening for accommodating a flat tube of the heat exchanger. The opening can have a cross section, which is adapted to the flat tube.

The passage has a collar, which extends away from the longitudinal duct, thus does not protrude into the longitudinal duct. The collar can be torn from the inside to the outside. The respective flat tube can be inserted through the opening and the collar of the passage, wherein the front edge can be flush with the base area. The available space inside the heat exchanger or condenser, respectively, which has to be filled by the refrigerant, can be significantly reduced thereby. When using a comparatively expensive refrigerant, such as, for example, R1234yf, a reduction of the production or operating costs, respectively, of the heat exchanger can also be attained.

It can be provided that the inner base surface of the base and/or the surface areas of the collar, which are used for soldering, are provided with a solder plating. This has the advantage that the solder material does not need to flow around the punching edge and the soldering process is thus improved.

The cover has at least one notch, which is located opposite the passage and which is embodied for accommodating a subarea of a flat tube. This has the advantage that a flat tube, which is inserted slightly deeper due to production tolerances, does not adjoin the cover edge. It is thus prevented that the flat tube is damaged.

In the case of a further advantageous embodiment of the solution according to the invention, it is provided that the cover has an outer diameter, which is smaller than or equal to a width of the flat tube, wherein the notch is embodied inside the outer diameter.

In the case of a further advantageous embodiment of the solution according to the invention, it is provided that the collector tube has at least two notches, which are located opposite one another and which are each embodied for accommodating a subarea of a flat tube.

In the case of a further advantageous embodiment of the solution according to the invention, it is provided that the notch has a trapezoidal embodiment. It can be provided thereby that the notch widens towards the flat tube.

In the case of a further advantageous embodiment of the solution according to the invention, it is provided that the opening of the passage tapers at least partially towards the longitudinal duct. By means of a counter-punching during the production of the collar of the passages, an insertion bevel for the flat tubes can thus be created, which simplifies the insertion of the flat tubes. It can also be provided that the opening of the passage initially tapers towards the longitudinal duct and then widens again. The narrowest point of such an opening is thereby dimensioned in such a way that an insertion of the flat tube is possible.

In the case of an advantageous further development of the solution according to the invention, it is provided that the base has at least one reinforcement bead. It can be provided that the base has at least two passages, which are spaced apart from one another, wherein at least one reinforcement bead is provided between these passage in the base. The reinforcement bead can have a curvature, which is embodied so as to point towards the longitudinal duct. It can also be provided that the reinforcement bead has a longitudinal extension, which is essentially parallel to the longitudinal extension of the longitudinal duct. An advantage of this is that the pressure stability of the entire collector tube is increased.

In the case of a further advantageous embodiment of the solution according to the invention, it is provided that the base has an outer base surface, which is at least partially provided with a protective layer. This protective layer can be a plating of the outer base surface with an alloy, which has, for example, a higher corrosion resistance than the base material of the base. Such a protective plating cannot be used in the case of passages, which protrude into the longitudinal duct, because the protective plating is generally not suitable for soldering. The service life of the heat exchanger or condenser, respectively, is thus significantly improved with the use of passages, which extend away from the longitudinal duct, in combination with a protective layer. It can also be provided that the entire outer base surface of the base is provided with a protective plating. It can further be provided that at least a subarea or also the entire inner base surface is provided with a solder plating.

In the case of a further advantageous embodiment of the solution according to the invention, it is provided that the base has a recess, through which a separating element is introduced into the collector tube in an insertion position. The separating element has a separating wall comprising a separating wall thickness, wherein a clearance fit is present between the separating wall and the recess in response to the insertion of the separating element. The separating element can thus be inserted easily into the recess. The separating element is used to segment the longitudinal duct and to create, for example a meander-shaped flow guidance of the refrigerant through the flat tubes. The surface area of the separating wall can essentially correspond to the cross sectional surface of the longitudinal duct, wherein the shape of the separating wall is selected in such a way that a fluid-tight separation of two segments of the longitudinal duct is ensured.

The separating wall has at least one elevation for attaining an increase of the separating wall thickness in a subarea of the separating element, wherein, in the insertion position of the separating element, the at least one elevation is arranged in the area of the recess, wherein, in the insertion position of the separating element, a press fit is present between the elevation and the recess. The elevation can have a circular contour. It is thus prevented that the separating element falls out prior to and/or during the soldering process. The separating wall can be inserted completely into the collector tube, wherein the insertion position is characterized in that the separating element bears on the arch area of the cover. Tolerances in the height of the cover contour thus have no impact on the tightness of the separating wall.

In the case of an advantageous further development of the solution according to the invention, it is provided that the separating element has a ledge, which, in the insertion position of the separating element, is arranged outside of the longitudinal duct. This leads to an improved separation of the separating elements as loose material, wherein a mutual flat attachment is avoided. This can provide for a supply of the separating elements, in response to which separating elements, for example, are guided to the assembly location by a vibrating conveyor via a sliding rail. It can be provided that the ledge thereby hooks into a sliding rail.

In the case of an advantageous further development of the solution according to the invention, it is provided that the base area and the arch area limits the longitudinal duct, wherein the longitudinal duct has an essentially semi-circular cross section, wherein the semi-circular contour can be formed by the arch area.

In the case of an advantageous further development of the solution according to the invention, it is provided that the inner base surface of the base and/or the surface areas of the collar, which are used for soldering, are provided with a solder plating.

In the case of an advantageous further development of the solution according to the invention, it is provided that the cover has an outer diameter, which is smaller than or equal to a width of the flat tube, wherein the notch is embodied inside the outer diameter, wherein the cover has an inner diameter, wherein the wall thickness of the cover essentially corresponds to half of the difference between outer diameter and inner diameter, wherein the notch is embodied in the intermediate area between outer diameter and inner diameter.

The invention further relates to a heat exchanger, in particular a condenser for a vehicle, which is equipped with a plurality of flat tubes, which are spaced apart from one another. The flat tubes are thereby fluidically connected to one another by means of at least one collector tube according to the invention, which is described above. For example two collector tubes or also only one collector tube can be provided, wherein in the case of one collector tube, the flat tubes can have a U-shaped course. It can also be provided that a collector tube has an inlet and an outlet, which can be connected to an air conditioning circuit of a vehicle. The flat tubes are introduced into openings of the collector tube, whereby front edges of the flat tubes are essentially flush with the base. If the base provides for a curvature, the front edges of the flat tubes can also have a curved course, so as to attain a flush closure with the base and so as to thus not reduce the flow cross section of the longitudinal duct.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the below description, whereby identical reference numerals refer to identical or similar or functionally identical components.

BRIEF DESCRIPTION OF THE DRAWINGS

In each case schematically.

DETAILED DESCRIPTION

Figure 1:
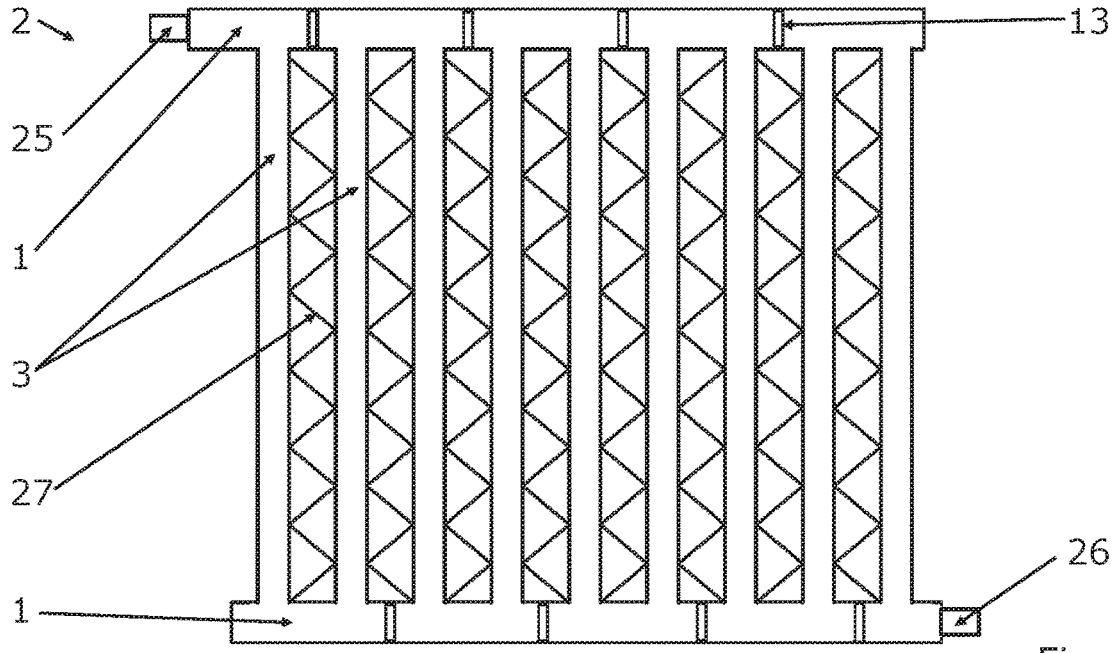
FIG. 1 shows a heat exchanger or condenser, respectively.

As illustrated in FIG. 1, the heat exchanger 2 has a plurality of flat tubes 3, which are fluidically connected to two collector tubes 1. The collector tubes 1 and the flat tubes 3 are arranged essentially transversely to one another. A first collector tube 1 is provided with an inlet 25, and a second collector tube 1 has an outlet 26. The inlet 25 and the outlet 26 can be connected to a non-illustrated air conditioning circuit of a vehicle, wherein the air conditioning circuit can be used to regulate the room temperature in the vehicle interior.

If the heat exchanger 2 is used as condenser, a refrigerant of the air conditioning circuit enters in the vaporous aggregate state into the collector tube 1 through the inlet 25 and flows through the flat tubes 3. Separating elements 13 are inserted in the collector tubes 1 in such a way that a meander-shaped flow guidance of the refrigerant results. While the refrigerant flows through the flat tubes 3, it dissipates its heat energy to the flat tubes 3 or to the surrounding area of the flat tubes 3, respectively, so that it cools down and condenses. Fins 27, which increase the mechanical stability of the heat exchanger 2 and which enlarge the surface, via which the heat energy of the refrigerant can be discharged to the external environment, are arranged between the flat tubes 3. The condensed refrigerant is supplied to the air conditioning circuit via the outlet 26.

Figure 2:
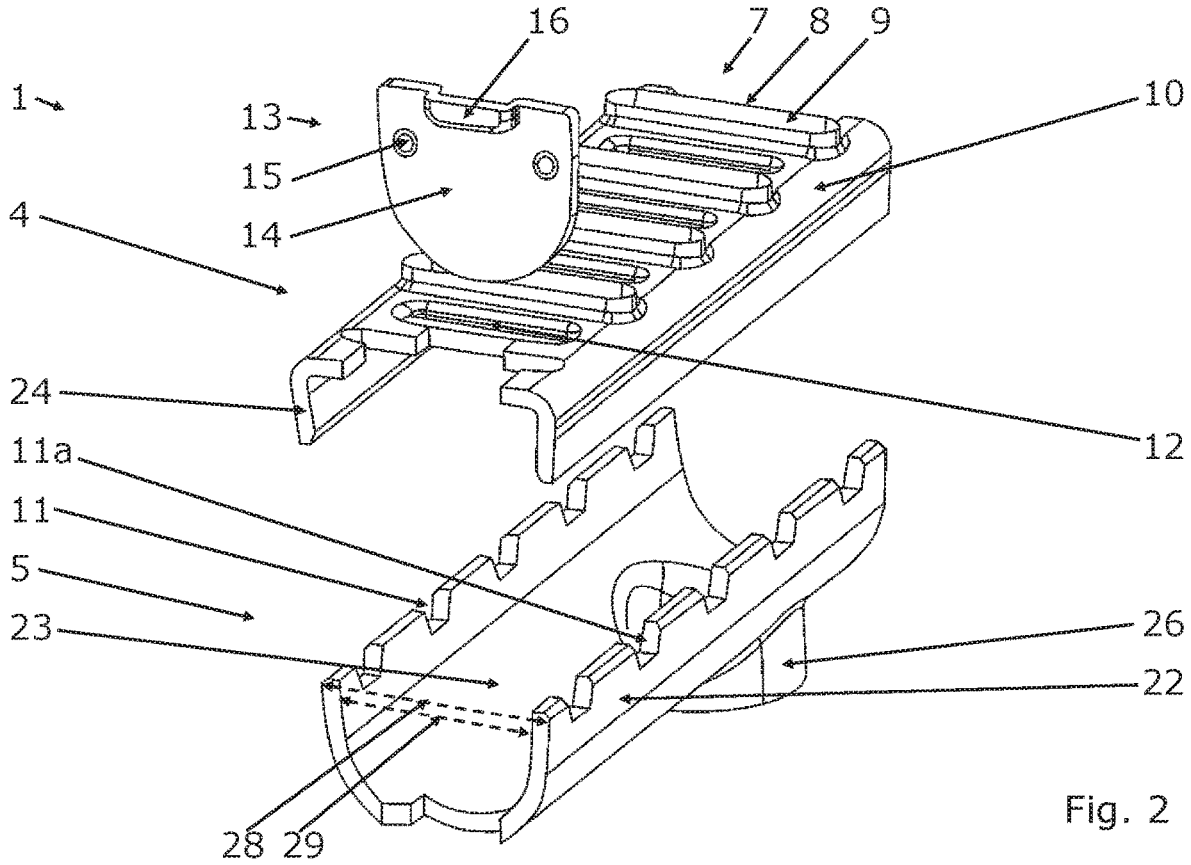
FIG. 2 shows a perspective view of a collector tube according to the invention prior to the assembly.
Figure 3:
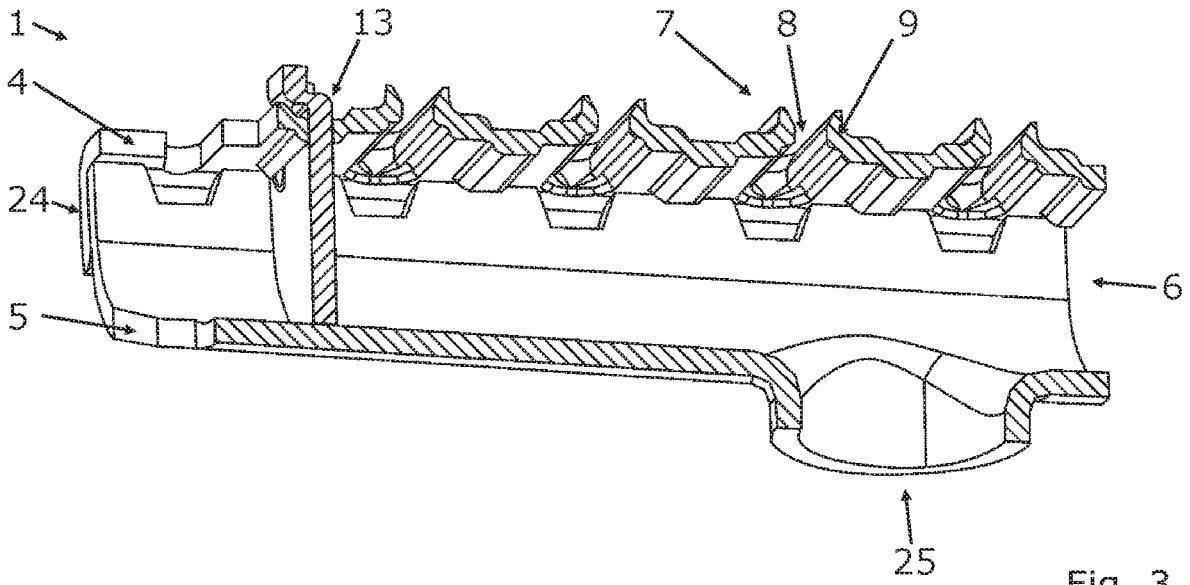
FIG. 3 shows a perspective longitudinal section of an assembled collector tube.
Figure 4:
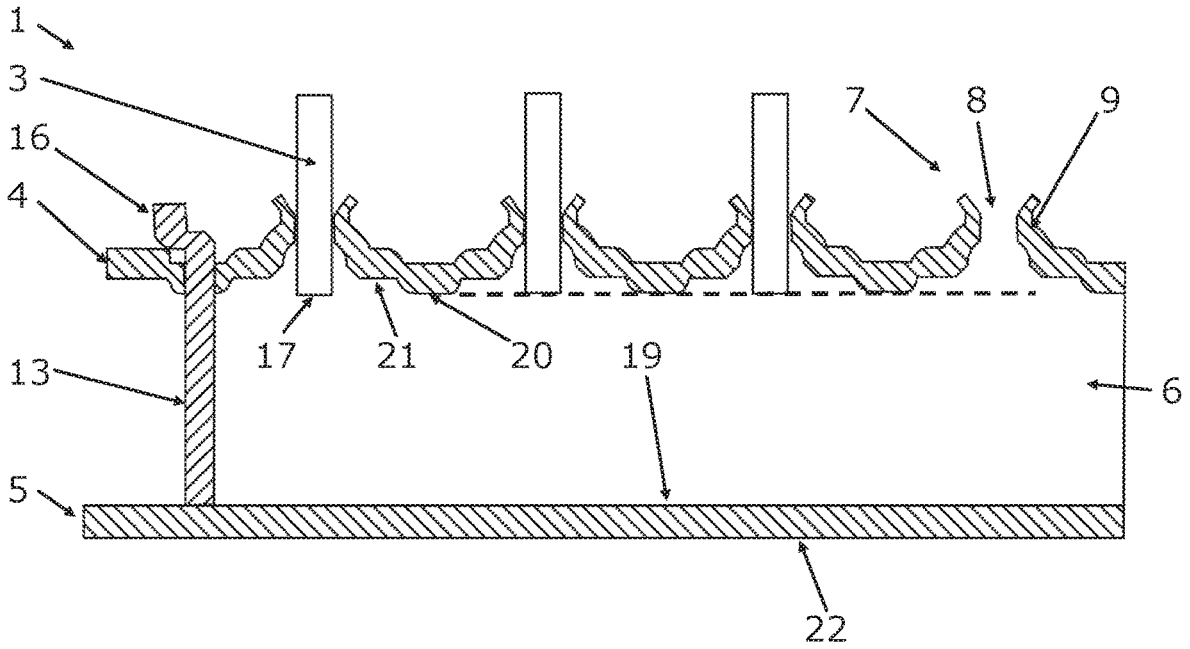
FIG. 4 shows a longitudinal section along a collector tube according to the invention.

FIG. 2 shows a perspective view of a collector tube 1 according to the invention prior to the assembly. FIG. 4 shows a longitudinal section of an assembled collector tube 1, and FIG. 3 shows a perspective longitudinal section of an assembled collector tube 1.

The collector tube 1 consists of a base 4 and a cover 5, wherein the base 4 has a base collar 34. Compared to the cover 5, the base 4 is embodied to be essentially flat. The base 4 and the cover 5 can be made of a sheet metal, wherein the collector tubes 1 as well as the entire heat exchanger 2 can be produced by means of soldering.

The base 4 has an outer base surface 10 and an inner base surface 21. The outer base surface 10 is defined as the surface of the base 4, which is in contact with the external environment in the case of the assembled collector tube 1. The remaining surface of the base 4, which is not in contact with the external environment in the case of the assembled collector tube 1, is defined as inner base surface 21.

The cover 5 has an outer cover surface 22 and an inner cover surface 23. The outer cover surface 22 is defined as the surface of the cover 5, which is in contact with the external environment in the case of the assembled collector tube 1. The remaining surface of the cover 5, which is not in contact with the external environment in the case of the assembled collector tube 1, is defined as inner cover surface 23.

A subarea of the inner base surface 21 bears on a subarea of the inner cover surface 23, wherein this subarea of the inner base surface 21 is essentially formed by the base collar 24. A further subarea of the inner base surface 21 is embodied as base area 20 and is spaced apart from a further subarea of the inner cover surface 23, wherein this subarea of the inner cover surface 23 embodies an arch area 19. The base area 20 and the arch area 19 limit a longitudinal duct 6, through which a refrigerant can flow. Due to the fact that the curvature radius of the arch area 19 is smaller than the curvature radius of the base area 20, the arch area 19 limits a larger cross sectional surface of the longitudinal duct 6 than the base area 20.

The base 4 has a plurality of passages 7, which are arranged spaced apart from one another along the longitudinal extension of the longitudinal duct 6. Each passage 7 has an opening 8 and a collar 9, which extends away from the longitudinal duct 6. The opening 8 has a wide edge and a narrow edge, which correspond to the dimensions of the flat tubes 3 in such a way that the flat tubes 3 can be inserted through the respective opening 8. It can be seen particularly well in FIG. 4 that the opening 8 of the passage 7 can initially taper towards the longitudinal duct 6 and can subsequently widen again. The insertion of the respective flat tube 3 into the respective passage 7 can be simplified thereby.

In areas located opposite a passage 7, the cover 5 has notches 11. The notches 11 can be punched out of the areas, which are in contact with the base collar after the assembly. These notches 11 can be embodied to be trapezoidal.

The cover 5 has an outer diameter 28, which is smaller than or equal to a width of the flat tube, wherein the notch 11 is embodied inside the outer diameter 28. The cover 5 has an inner diameter 29, wherein the wall thickness of the cover 5 essentially corresponds to half of the difference between outer diameter 28 and inner diameter 29.

The notch 11 is embodied in the intermediate area between outer diameter 28 and inner diameter 29.

The collector tube 1 and/or the cover 5 further has at least two notches 11 and 11*a*, which are located opposite one another and which are each embodied for accommodating a subarea of a flat tube.

The notches 11 and 11*a* have a trapezoidal embodiment, wherein the notches 11 and 11*a* widen towards the flat tube.

The base 4 has recesses 12, into which the separating elements 13 can be inserted. The separating elements 13 can be inserted prior to or also after the assembly of the base 4 and of the cover 5. The separating element 13 is used to segment the collector tube 1 or longitudinal duct 6, respectively, in order to attain a desired flow direction of the refrigerant through the heat exchanger 2.

The separating element 13 has a separating wall 14 comprising a separating wall thickness and at least one elevation 15. In FIG. 2, the separating element 13 is illustrated prior to the insertion into the base 4, and is shown in an insertion position in FIG. 3 as well as FIG. 4. The separating wall 14 has a shape, which corresponds to the cross sectional contour of the longitudinal duct 6, so that the separating element 13, in its insertion position, provides for a fluid-tight segmenting or separation, respectively, of the collector tube 1 or of the longitudinal duct 6, respectively. The elevation 15 leads to a local increase of the separating wall thickness. The elevation 15 can be produced by means of additionally applied material or also, for example, by means of a forming process. The dimensions of the recess 12 are selected in such a way that the separating wall 14 can be pushed into the recess 12 without large resistance, wherein the dimensions of the elevation 15 are selected in such a way that, in the insertion position of the separating element 13, the elevation 15 is pressed into the recess 12.

The separating element 13 can have a ledge 16, which is arranged outside of the longitudinal duct 6 in the insertion position of the separating element 13. The ledge 15 can be produced by means of additionally applied material or also for example by means of a forming process.

It can be seen well in FIG. 4 that the front edges 17 of the flat tubes are essentially flush with the base 4 or with the base area 19, respectively. To clarify this, a dashed horizontal line is added in the drawing.

The invention claimed is:

1. A collector tube for a heat exchanger, which has at least one flat tube, comprising:

a base and a cover;

wherein the cover is arranged so as to be located opposite the base;

wherein the base and the cover embody a longitudinal duct;

wherein the base has at least one passage comprising an opening for accommodating the at least one flat tube of the heat exchanger;

wherein the at least one passage has a collar, which extends away from the longitudinal duct;

wherein the cover has at least one notch, which is located opposite the at least one passage and which is embodied for accommodating a subarea of the at least one flat tube;

wherein the base has a recess, through which a separator is introduced into the collector tube in an insertion position;

wherein the separator has a separating wall comprising a separating wall thickness, wherein a clearance fit is present between the separating wall and the recess in response to the insertion of the separator;

wherein the separating wall provides at least one elevation for attaining an increase of the separating wall thickness in a subarea of the separator;

wherein in the insertion position, the at least one elevation is arranged in an area of the recess; and wherein in the insertion position, a press fit is present between the at least one elevation and the recess.

2. The collector tube according to claim 1, wherein the cover has an outer diameter, which is smaller than or equal to a width of the at least one flat tube, wherein the notch is embodied inside the outer diameter.

3. The collector tube according to claim 1, wherein the at least one notch includes at least two notches, which are located opposite one another and which are each embodied for accommodating a subarea of the at least one flat tube.

4. The collector tube according to claim 1, wherein the at least one notch has a trapezoidal embodiment.

5. The collector tube according to claim 1, wherein the opening of the at least one passage tapers at least partially towards the longitudinal duct.

6. The collector tube according to claim 1, wherein the base has at least one reinforcing bead.

7. The collector tube according to claim 1, wherein the base has an outer base surface, which is at least partially provided with a protective layer.

8. The collector tube according to claim 7, wherein the separator has a ledge, which, in the insertion position, is arranged outside of the longitudinal duct.

9. A heat exchanger, comprising a plurality of flat tubes, which are spaced apart from one another;

at least one collector tube fluidically connecting the flat tubes to one another, the at least one collector tube having a base and a cover arranged opposite one another and employing a longitudinal duct;

wherein the base has a passage for each flat tube, each passage comprising an opening for accommodating a respective one of the flat tubes;

wherein each passage has a collar extending away from the longitudinal duct;

wherein the cover has at least one notch for each flat tube, each notch being located opposite a corresponding passage and being embodied for accommodating a subarea of a respective one of the flat tubes;

wherein the flat tubes are each introduced into the opening of a corresponding passage;

wherein front edges of the flat tubes are substantially flush with the base;

wherein the cover has an outer diameter, which is smaller than or equal to a width of the at least one flat tube, wherein the notch is embodied inside the outer diameter, wherein the notch is embodied in an intermediate area between the outer diameter and an inner diameter of the cover, and a wall thickness of the cover substantially corresponds to half of a difference between the outer diameter and the inner diameter.

10. The collector tube according to claim 1, wherein a base area of the base and an arch area of the cover delimits the longitudinal duct such that the longitudinal duct has a substantially semi-circular cross section with a semi-circular contour formed by the arch area.

11. The collector tube according to claim 1, wherein at least one of an inner base surface of the base and surface areas of the collar are provided with a solder plating.

12. The collector tube according to claim 2, wherein the notch is embodied in an intermediate area between the outer diameter and an inner diameter of the cover, and a wall thickness of the cover substantially corresponds to half of a difference between the outer diameter and the inner diameter.

13. The collector tube according to claim 2, wherein the at least one notch includes at least two notches, which are located opposite one another and which are each embodied for accommodating a subarea of the at least one flat tube.

14. The collector tube according to claim 2, wherein the at least one notch has a trapezoidal embodiment.

15. The collector tube according to claim 2, wherein the opening of the at least one passage tapers at least partially towards the longitudinal duct.

16. The collector tube according to claim 2, wherein the base has at least one reinforcing bead.

17. The collector tube according to claim 2, wherein the base has an outer base surface, which is at least partially provided with a protective layer.

18. A collector tube for a heat exchanger, which has at least one flat tube, comprising:

a base and a cover arranged opposite one another and embodying a longitudinal duct;

wherein the base has at least one passage comprising an opening for accommodating the at least one flat tube, and a collar extending away from the longitudinal duct;

wherein the cover has at least one notch, which is located opposite the at least one passage and which is embodied for accommodating a subarea of the at least one flat tube; and wherein a base area of the base and an arch area of the cover delimits the longitudinal duct such that the longitudinal duct has a substantially semi-circular cross section with a semi-circular contour formed by the arch area.

19. The collector tube according to claim 18, wherein the at least one notch has a trapezoidal embodiment.

* * * * *